US009090396B2

(12) United States Patent
Owensby et al.

(10) Patent No.: US 9,090,396 B2
(45) Date of Patent: Jul. 28, 2015

(54) POUCH WITH METERING HANDLE FOR DISPENSING FLOWABLE PRODUCTS

(71) Applicant: Cryovac, Inc., Duncan, SC (US)

(72) Inventors: Joseph E. Owensby, Spartanburg, SC (US); Howard Dean Conner, Mauldin, SC (US); Billy Wayne Austin, Duncan, SC (US)

(73) Assignee: Cryovac, Inc., Charlotte, NC (US)

( * ) Notice: Subject to any disclaimer, the term of this patent is extended or adjusted under 35 U.S.C. 154(b) by 141 days.

(21) Appl. No.: 13/864,323

(22) Filed: Apr. 17, 2013

(65) Prior Publication Data

US 2014/0312063 A1 Oct. 23, 2014

(51) Int. Cl.

| | |
|---|---|
| ***B65D 83/38*** | (2006.01) |
| ***B65D 75/00*** | (2006.01) |
| ***B65D 33/00*** | (2006.01) |
| ***B65D 75/58*** | (2006.01) |
| ***B65D 81/32*** | (2006.01) |

(52) U.S. Cl.

CPC ..... *B65D 83/38* (2013.01); *B65D 33/004* (2013.01); *B65D 75/008* (2013.01); *B65D 75/5883* (2013.01); *B65D 81/3261* (2013.01)

(58) Field of Classification Search

USPC ..... 222/94, 105, 107, 23, 25, 158, 129

See application file for complete search history.

(56) References Cited

U.S. PATENT DOCUMENTS

| | | | | |
|---|---|---|---|---|
| 2,976,988 | A | | 6/1957 | Schneider |
| 3,141,574 | A | | 7/1964 | Donoghue |
| 4,105,142 | A | | 8/1978 | Morris |
| 4,377,192 | A | | 3/1983 | Gautier |
| 4,432,763 | A | | 2/1984 | Manschot et al. |
| 4,457,454 | A | | 7/1984 | Meshberg |
| 4,529,102 | A | | 7/1985 | Quinn et al. |
| 4,629,080 | A | | 12/1986 | Carveth |
| 4,646,948 | A | * | 3/1987 | Jennings ..... 222/454 |
| 4,743,236 | A | | 5/1988 | Manschot |
| 4,974,732 | A | | 12/1990 | Sullivan et al. |
| 5,746,352 | A | | 5/1998 | Corella |
| 5,805,189 | A | | 9/1998 | Edelhof |
| 5,832,698 | A | | 11/1998 | Huguenin |
| 5,833,124 | A | | 11/1998 | Groves et al. |
| 5,944,230 | A | | 8/1999 | Chiang |
| 6,244,468 | B1 | | 6/2001 | Farmer et al. |

(Continued)

FOREIGN PATENT DOCUMENTS

| | | |
|---|---|---|
| CN | 1786528 A | 6/2006 |
| DE | 4022616 A1 | 1/1992 |

(Continued)

*Primary Examiner* — Donnell Long
(74) *Attorney, Agent, or Firm* — Ashley D. Wilson

(57) ABSTRACT

The presently disclosed subject matter is a novel adaptation of a pouch that enables the measurement and dispensing of unit doses of flowable products. Particularly, the pouch comprises a storage compartment that houses a flowable product prior to dispensing. The pouch further includes a dispensing compartment comprising a support member with a fitment to accommodate dispensing out of the pouch. The support member can function to support the pouch, such as for use as a handle or gripping area. Further, the support member allows the structural integrity of the pouch to remain intact. The pouch further includes a dividing seal comprising a one-way channel that facilitates the movement of flowable product from the storage compartment to the dispensing compartment so that dispensing and/or metering can occur.

6 Claims, 8 Drawing Sheets

(56) References Cited

U.S. PATENT DOCUMENTS

| | | | | |
|---|---|---|---|---|
| 6,330,960 | B1 * | 12/2001 | Faughey et al. | 222/205 |
| 6,375,037 | B1 | 4/2002 | Bell | |
| 6,464,394 | B1 | 10/2002 | Galomb | |
| 6,679,304 | B1 | 1/2004 | Vacca | |
| 6,685,058 | B2 | 2/2004 | Redmond | |
| 6,688,467 | B2 | 2/2004 | Krupka et al. | |
| 6,719,678 | B1 | 4/2004 | Stern | |
| 6,851,578 | B2 | 2/2005 | Hagihara | |
| 6,857,779 | B2 | 2/2005 | Olin | |
| 6,921,204 | B2 | 7/2005 | Edwards et al. | |
| 6,997,858 | B1 | 2/2006 | Moravek | |
| 7,004,354 | B2 | 2/2006 | Harper | |
| 7,055,720 | B1 | 6/2006 | Pritchard | |
| 7,144,159 | B2 | 12/2006 | Piotrowski et al. | |
| 7,207,717 | B2 | 4/2007 | Steele | |
| 7,213,385 | B2 | 5/2007 | Knoerzer et al. | |
| 7,588,172 | B2 * | 9/2009 | Yamamoto et al. | 222/158 |
| 8,028,860 | B2 | 10/2011 | Seelhofer | |
| 2003/0147568 | A1 | 8/2003 | Edwards et al. | |
| 2005/0173455 | A1 | 8/2005 | Hagihara | |
| 2006/0072858 | A1 | 4/2006 | Kurosawa et al. | |
| 2006/0081648 | A1 | 4/2006 | Harper | |
| 2006/0113320 | A1 | 6/2006 | Harper | |
| 2006/0255068 | A1 | 11/2006 | Genosar | |
| 2007/0045133 | A1 | 3/2007 | Harper | |
| 2077/0175920 | | 8/2007 | Takada et al. | |
| 2010/0054636 | A1 | 3/2010 | Owensby et al. | |
| 2012/0012594 | A1 | 1/2012 | Boegli et al. | |

FOREIGN PATENT DOCUMENTS

| | | | |
|---|---|---|---|
| GB | 2227004 | A | 7/1990 |
| GB | 2227228 | A | 7/1990 |
| JP | 1077051 | A | 3/1998 |
| JP | 2002370753 | A | 12/2002 |
| JP | 2009255958 | A | 11/2009 |
| WO | WO0164542 | A2 | 9/2001 |

* cited by examiner

POUCH WITH METERING HANDLE FOR DISPENSING FLOWABLE PRODUCTS

TECHNICAL FIELD

The presently disclosed subject matter relates generally to a system and method for dispensing metered doses of a flowable product from a pouch. More particularly, the presently disclosed subject matter is directed to a dispensing system comprising a pouch with a handle that allows the flowable product packaged within a main storage compartment to be metered and dispensed.

BACKGROUND

Although most existing devices are rigid containers, flexible packaging is increasingly becoming one of the primary forms of consumer packaging for flowable products. Packages of this kind include a wide variety of containers, from simple packages to sophisticated contoured designs that function as stand-up pouches, flat pouches, or even box shapes. These flexible packages are economical packaging solutions that allow compact shipping to the filler, can include improved barrier or other film qualities, and are suitable for high-quality printing and finishing. In addition, flexible packaging (as compared to relatively rigid packaging, such as cartons) take up very little volume until after the package is filled, providing a significant storage advantage. Further, after the flexible package is emptied of its contents, it readily collapses, thereby reducing its volume to approximately that of the unfilled package, which proves to be a considerable benefit.

For many applications, the entire contents of a flexible package can be used at one time. For other applications, only a small amount of product is required for an application, such as washing detergent, bleach, fabric softener, and the like. In cases where only a small amount of the product is required, there is generally a need to measure the amount of the product to be dispensed in each application.

Commonly, users are required to utilize a package cap as the measuring device. The cap can have a built-in cup with various graduations or "fill lines" representing different fluid volumes. Where the measuring aids are not incorporated into the package itself, users utilize other methods to measure the amount of flowable product necessary for a specific application. The extra time and effort needed to find and utilize a suitable measuring device presents added difficulties. The procedure of pouring the product from the package to a measuring container, and then transferring from the measuring container to an end use is a tedious and time-consuming process. In addition, because of the variations in size and shape, such sight-measuring aids can yield inaccurate and imprecise results.

There are many different containers that dispense flowable products in measured amounts, where the container holds a substantially greater amount of product relative to the dispensed amount. Many of these devices have the capacity to store, measure, and dispense fluids without the need for sight measuring. Such characteristics are desirable, especially when contact with the packaged product can be harmful, such as with poisons, bleach, etc. Typically, however, prior art devices capable of dispensing a measured volume of fluid are unduly complex in design and manufacture, are undependable, and can be expensive.

Thus, it would be desirable to provide a flexible metering package that lacks the negative characteristics noted in the prior art.

SUMMARY

In some embodiments, the presently disclosed subject matter is directed to a flexible dispensing pouch comprising a storage compartment configured to house a flowable product prior to metering, dispensing, or both. In some embodiments, the dispensing compartment comprises a rigid or semi-rigid support member that houses the flowable product during metering and/or dispensing. In some embodiments, the support member comprises a dispensing unit that allows the flowable product to exit compartment. In some embodiments, the dispensing compartment further comprises a dividing seal that separates the storage compartment from the dispensing compartment, wherein the dividing seal comprises a one-way channel to allow communication between the two compartments.

In some embodiments, the presently disclosed subject matter is directed to a method of dispensing a flowable product from a flexible pouch. The method comprises providing a flexible dispensing pouch comprising a storage compartment, dispensing compartment, and a dividing seal as disclosed herein. The method further comprises filling the storage compartment of the pouch with at least one flowable product, increase the internal pressure within the storage compartment to force flowable product through the channel into the support member, and ceasing pressure once a desired amount of flowable product has entered the support member. The pouch contents are then dispensed through a dispensing unit.

In some embodiments, the presently disclosed subject matter is directed to a method of metering and dispensing a flowable product from a flexible pouch. Particularly, the method comprises providing a flexible dispensing pouch comprising a storage compartment, dispensing compartment, and a dividing seal as disclosed herein. In some embodiments, the pouch dispensing compartment, support member, or both are demarcated to accommodate metered dispensing. The method comprises filling the storage compartment of the pouch with at least one flowable product, increasing the internal pressure within the storage compartment to force flowable product through the channel into the support member, and ceasing pressure once a desired amount of flowable product has been metered. The pouch contents can then be dispensed through a dispensing unit.

DETAILED DESCRIPTION

I. General Considerations

Figure 1B:
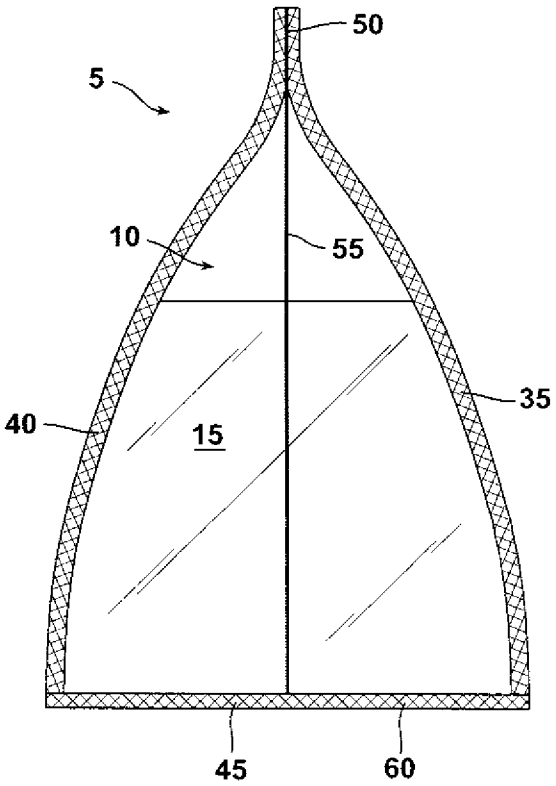
FIG. 1*b* is a side elevation view of the pouch of FIG. 1*a*.
Figure 1A:
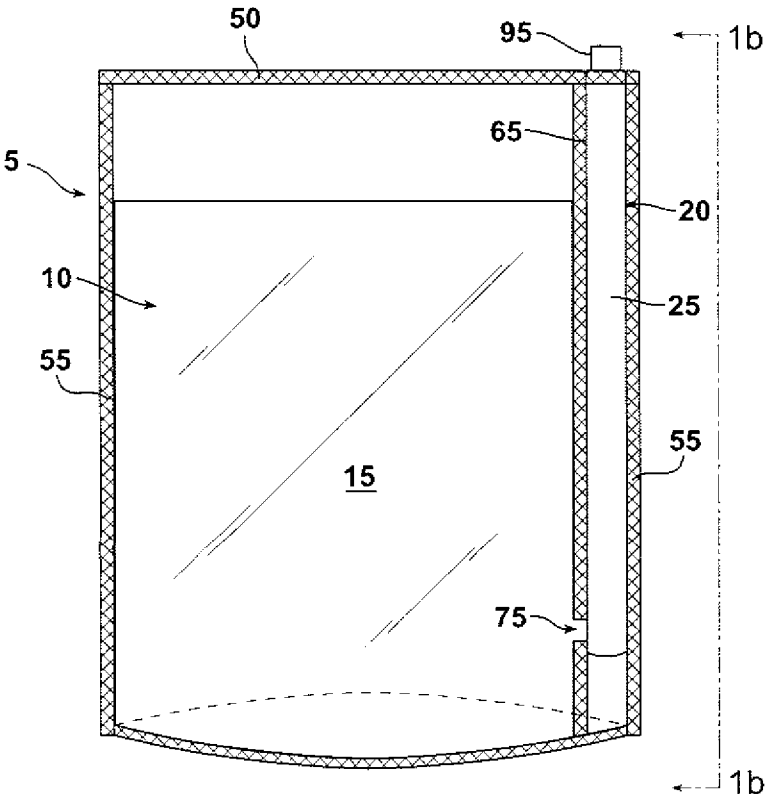
FIG. 1*a* is a front elevation view of a pouch in accordance with some embodiments of the presently disclosed subject matter.

The presently disclosed subject matter is a novel adaptation of a pouch that enables the dispensing and/or metering of unit doses of flowable products. Particularly, as illustrated in FIG. 1*a*, pouch 5 comprises storage compartment 10 that houses flowable product 15 prior to dispensing. Pouch 5 further includes dispensing compartment 20 comprising support member 25 with dispensing unit 95 to accommodate dispensing out of the pouch. Support member 25 can function to support the pouch, such as for use as a handle or gripping area. Further, the support member allows the structural integrity of the pouch to remain intact. The pouch further includes dividing seal 65 comprising one-way channel 75 that facilitates the movement of flowable product 15 from the storage compartment to the dispensing compartment so that dispensing and/or metering can occur.

II. Definitions

While the following terms are believed to be understood by one of ordinary skill in the art, the following definitions are set forth to facilitate explanation of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, device, and materials are now described.

Following long-standing patent law convention, the terms "a", "an", and "the" can refer to "one or more" when used in the subject specification, including the claims. Thus, for example, reference to "a pouch" (e.g., "a dispensing pouch") includes a plurality of such pouches, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "abuse layer" refers to an outer film layer and/or an inner film layer, so long as the film layer serves to resist abrasion, puncture, and other potential causes of reduction of package integrity, as well as potential causes of reduction of package appearance quality. The abuse layer can comprise any polymer, so long as the polymer contributes to achieving an integrity goal and/or an appearance goal. In some embodiments, the abuse layer can comprise polyamide, ethylene/propylene copolymer (such as, but not limited to, nylon 6, nylon 6/6, amorphous nylon), and/or combinations thereof.

As used herein, the term "barrier" and the phrase "barrier layer", as applied to films and/or film layers, refers to the ability of a film or film layer to serve as a barrier to gases and/or odors. Examples of polymeric materials with low oxygen transmission rates useful in such a layer can include (but are not limited to): ethylene/vinyl alcohol copolymer (EVOH), polyvinylidene dichloride (PVDC), vinylidene chloride copolymer such as vinylidene chloride/methyl acrylate copolymer, vinylidene chloride/vinyl chloride copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). Oxygen barrier properties can be further enhanced by the incorporation of an oxygen scavenger, such as an organic oxygen scavenger (e.g., comprising poly(ethylene/methyl acrylate/cyclohexene methyl acrylate, with or without a transition metal catalyst). In some embodiments, metal foil, metallized substrates (e.g., metallized polyethylene terephthalate (PET), metallized polyamide, or metallized polypropylene), or coatings comprising SiOx or AlOx compounds can be used to provide low oxygen transmission to the disclosed package.

As used herein, the term "bulk layer" refers to any layer of a film that is present for the purpose of increasing the abuse-resistance, toughness, modulus, etc., of a film. In some embodiments, bulk layers can comprise polyolefin; in some embodiments, at least one member selected from the group comprising ethylene/alpha-olefin copolymer, ethylene/alpha-olefin copolymer plastomer, low density polyethylene, and linear low density polyethylene.

As used herein, the term "channel" refers to one or more holes, gaps, cuts, slits, valves, and the like.

The term "compartment" as used herein refers to, for example, any unit containing, or capable of containing, flowable product therein. As used herein, the "storage compartment" refers to the compartment where the flowable material is contained prior to dispensing and/or metering. As used herein, the "dispensing compartment" refers to the compartment where the flowable material is contained during metering and/or dispensing.

As used herein, the term "dispenser" refers to a structure capable of holding and dispensing a product disposed therein.

As used herein, the term "dispensing" refers to the process of distributing or administering a product from a dispenser.

As used herein, the term "dispensing compartment" refers to the region of a pouch that houses the portion of the product contained therein that is to be metered and/or dispensed. That is, when multiple doses of a product are to be dispensed, the body of the product is housed in the storage compartment, and the portion to be metered and/or dispensed is housed in the dispensing compartment.

As used herein, the term "dispensing unit" includes any device that allows or facilitates the transfer of product from inside a container (such as a pouch) to the outside of the container. For example, dispensing units suitable for use with the presently disclosed subject matter can include (without limitation) valves, fitments, ports, port enclosure assemblies, and other means for accessing a pouch. For example, pouch fitments provide ports for establishing fluid communication between the contents of a pouch and the outside environment.

As used herein, the term "film" includes, but is not limited to, a laminate, sheet, web, coating, and/or the like, that can be used to package a product.

As used herein, the term "flowable" refers to the ability of a composition to be transported by gravity or by conventional mechanical or pneumatic pumping means from a storage vessel, such as a pouch. For instance, in some embodiments, a flowable material can be a liquid.

The term "frangible" as used herein refers to a membrane or seal that is rupturable or fragile. It should be understood that the term "frangible" can indicate the susceptibility of being broken without implying weakness. Thus, in some embodiments, the frangible seal in an intact state serves to maintain its integrity and thus separate two or more areas or products, but in a broken or severed state allows for passage of these products along a delaminated seal area.

As used herein, the term "gravity flow" refers to the movement of a product, wherein the movement is caused primarily by gravitational force.

As used herein, the term "gusset" refers to the folded-in-and-out portions that form an expandable insert in a pouch.

As used herein, the term "metering" refers to the process of measuring out a specific amount of material.

The term "opaque" as used herein refers to the external appearance of a material, which can actually be translucent, but is not transparent to an optical image.

As used herein, the term "oriented" refers to a polymer-containing material that has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced almost to the original unstretched, i.e., pre-oriented dimensions. More particularly, the term "oriented", as used herein, can refer to oriented films, wherein the orientation can be produced in one or more of a variety of manners.

As used herein, the term "polymer" (and specific recited polymers) refers to the product of a polymerization reaction, and is inclusive of homopolymers, copolymers, terpolymers, etc.

As used herein, the term "polymerization" can be inclusive of homopolymerizations, copolymerizations, terpolymerizations, etc., and can include all types of copolymerizations such as random, graft, block, etc. In general, the polymers in the films of the presently disclosed pouches can be prepared in accordance with any suitable polymerization process, including slurry polymerization, gas phase polymerization, high pressure polymerization processes, and the like.

The term "sachet" as used herein refers to a closed receptacle for housing one or more products. The sachet is closed in the sense that the product(s), prior to initiation, are substantially retained within the sachet. The term "sachet" is not intended to be limiting and can include any of a wide variety of receptacles known in the art, including (but not limited to) pouches, bags, envelopes, capsules, packets, and containers.

The term "pouch" as used herein includes flexible pouches, bags, or like containers, either pre-made or made at the point of bagging. It should be understood that the disclosed pouches are constructed from flexible pouch materials, such as polymeric films.

As used herein, the term "seal" refers to any seal of a first region of a film surface to a second region of a film surface, wherein the seal is formed by heating the regions to at least their respective seal initiation temperatures. The heating can be performed by any one or more of a wide variety of manners, such as using a heated bar, hot air, infrared radiation, radio frequency radiation, etc.

As used herein, the phrases "seal layer," "sealing layer," "heat seal layer," and "sealant layer," refer to an outer film layer, or layers, involved in heat sealing the film to itself, another film layer of the same or another film, and/or another article which is not a film. Heat sealing can be performed in any one or more of a wide variety of manners, such as melt-bead sealing, thermal sealing, impulse sealing, ultrasonic sealing, hot air sealing, hot wire sealing, infrared radiation sealing, ultraviolet radiation sealing, electron beam sealing, etc.).

The term "storage compartment" as used herein refers to the region of a pouch that houses the body of the product contained therein. That is, when multiple doses of a product are to be dispensed, the body of the product is housed in the storage compartment, and the portion to be metered and/or dispensed is housed in the dispensing compartment.

As used herein, the phrase "tie layer" refers to any internal film layer having the primary purpose of adhering two layers to one another. In some embodiments, tie layers can comprise a non-polar or slightly polar polymer having a polar group grafted thereon. In some embodiments, tie layers can comprise at least one member selected from the group consisting of: polyolefin and modified polyolefin, e.g., ethylene-vinyl acetate copolymer, modified ethylene-vinyl acetate copolymer, heterogeneous and homogeneous ethylene alpha olefin copolymer, and modified heterogeneous and homogeneous ethylene alpha olefin copolymer; more preferably, tie layers can comprise at least one member selected from the group consisting of anhydride grafted linear low density polyethylene, anhydride grafted low density polyethylene, homogeneous ethylene alpha olefin copolymer, and anhydride grafted ethylene-vinyl acetate copolymer.

The term "transparent" as used herein refers to materials (i.e., films) that allow at least some amount of light to pass through the materials. In some embodiments, transparent materials allow greater than 50 percent, greater than 75 percent, greater than 90 percent, greater than 95 percent, or 100 percent of the light to pass through the materials.

The term "upright" as used herein refers to the orientation of the dispensing pouch when the base or bottom seal of a pouch is in contact with or adjacent to the ground.

III. The Dispensing Pouch

III.A. Generally

The presently disclosed subject matter will now be described more fully with reference to the accompanying drawings, in which some (but not all) embodiments are shown. Indeed, the presently disclosed subject matter can be embodied in many different forms and should not be construed as limited to the embodiments set forth herein. Like numbers refer to like elements throughout. Furthermore, the terms "top," "bottom," "first," "second," "upper," "lower," "side," and other similar terms as used herein refer to the structures shown in the drawings and are utilized only to facilitate describing the presently disclosed subject matter.

As set forth herein above, the presently disclosed subject matter is a novel adaptation of a pouch that enables the dispensing and/or metering of unit doses of flowable products. As illustrated in FIGS. 1*a* and 1*b*, pouch 5 can in some embodiments be a stand-up pouch, having a base for supporting the pouch in an upright position and can optionally include a gusset. To this end, the pouch can comprise side gussets that include a typical center fold and lower triangular regions formed by the folds of each side gusset, as would be known to those of ordinary skill in the art. See, for example, U.S. Pat. Nos. 6,857,779; 7,144,159; and 6,997,858, all of which are incorporated herein in their entireties by reference thereto. FIG. 1 *b* illustrates pouch 5 constructed from three separate pieces of film that are sealed together; namely, front sheet 35, rear sheet 40, and base sheet 45, all of which can be flexible materials. One of ordinary skill in the art would appreciate that in lieu of the front sheet 35 and rear sheet 40, a single sheet of film can be folded over and sealed around its edges. One of ordinary skill in the art would also understand that pouch 5 can comprise a bottom seal instead of base sheet 45 (see, for example, bottom seal 56 of the lay flat pouch of FIG. 2).

Front sheet 35 and rear sheet 40 are sealed together around their edges to form top seal 50 and side seals 55. Base sheet 45 is secured along its outer edges to the bottom edges of front sheet 35 and rear sheet 40 at base seal 60. Thus, in the embodiment shown in FIGS. 1*a* and 1*b*, pouch 5 is constructed as a conventional stand-up pouch (e.g., U.S. Pat. No. 6,375,037, incorporated herein in its entirety by reference thereto). In some embodiments, pouch 5 can have a w-shaped base that allows the stand-up features. The "w" shape can achieved by creating a w-shaped fold in base sheet 45, and then sealing it to the bottom of sheets 35 and 40 at base seal 60. The base sheet can also be sealed along a portion of the side edges of sheet 35 and 40.

Creation of seals 50, 55, 56 and 60 can be achieved by any of a number of methods well known in the art, including (but not limited to) the application of heat, pressure, mechanical closures, and/or adhesives. Furthermore, top seal 50, side seals 55, and base seal 60 (or bottom seal 56) can be constructed in any order. It should be understood that pouch 5 is not limited to stand up pouches, and can include any of a wide variety of pouches known and used in the art, including (but not limited to) lay flat pouches.

Pouch 5 can be made from any suitable material, and in some embodiments can be made from a polymeric material, with a thickness of between about 0.1 and 100 mils. However, the film used to construct pouch 5 can have any total thickness desired, so long as the film provides the desired properties, e.g., optics, modulus, seal strength, etc., for the particular packaging operation in which the film is used. Further, in some embodiments (such as, for example, in stand-up pouches) the particular type of material that is utilized to ensure that the pouch is of sufficient stiffness for enabling the pouch to remain generally upright relative to a horizontal surface when the bottom of the pouch is placed on the horizontal surface.

In some embodiments, film materials suitable for use in pouch 5 can be provided in sheet or film form and can be any of the films commonly used for the disclosed type of packaging (such as, but not limited to, olefin or amide polymers or copolymers). The film can be manufactured by any of a wide variety of film-forming processes known in the art (e.g., tubular or blown-film extrusion, coextrusion, extrusion coating, flat or cast film extrusion, and the like). A combination of these processes can also be employed. Additionally, in some embodiments, the presently disclosed subject matter can be applicable to various types of machines and processes, including vertical and horizontal form-fill-seal machines and processes.

The film can be oriented or non-oriented. In some embodiments, the film can be oriented in either the machine direction (i.e., longitudinal), the transverse direction, or in both directions (i.e., biaxially oriented) to enhance the optics, strength, and durability of the film. If the film is oriented, it can be heat set or annealed after orientation to reduce the heat shrink attribute to a desired level or to help obtain a desired crystalline state of the film.

In some embodiments, the film can comprise one or more polymeric materials in a barrier layer to serve as a barrier to gases and/or odors. Such barrier layers can include, but are not limited to, ethylene/vinyl alcohol copolymer (EVOH), polyvinylidene dichloride (PVDC), vinylidene chloride copolymer such as vinylidene chloride/methyl acrylate copolymer, polyamide, polyester, polyacrylonitrile (available as Barex™ resin), or blends thereof. Oxygen barrier materials can further comprise high aspect ratio fillers that create a tortuous path for permeation (e.g., nanocomposites). The oxygen barrier of materials can be further enhanced by the incorporation of an oxygen scavenger.

In some embodiments, the disclosed film can comprise one or more bulk layers to increase the abuse-resistance, toughness, modulus, etc., of the film. In some embodiments, the bulk layer can comprise polyolefin, including but not limited to, at least one member selected from the group consisting of ethylene/alpha-olefin copolymer, ethylene/alpha-olefin copolymer plastomer, low density polyethylene, and linear low density polyethylene.

In some embodiments, the presently disclosed film can include one or more tie layers. Such tie layers can include, but are not limited to, one or more polymers that contain mer units derived from at least one of $C_2$-$C_{12}$ alpha olefin, styrene, amide, ester, and urethane. In some embodiments, the tie layer can comprise one or more of anhydride-grafted ethylene/alpha olefin interpolymer, anhydride-grafted ethylene/ethylenically unsaturated ester interpolymer, and anhydride-grafted ethylene/ethylenically unsaturated acid interpolymer.

In some embodiments, the film can comprise one or more abuse layers that serve to resist abrasion, puncture, and other potential causes of reduction of package integrity, as well as potential causes of reduction of package appearance quality. Particularly, the film should have the required degree of tolerance to pinching and exposure to sharp edges. Abuse layers can comprise any polymer, so long as the polymer contributes to achieving an integrity goal and/or an appearance goal. In some embodiments, the abuse layer can comprise at least one member selected from the group consisting of polyamide, ethylene/propylene copolymer; in some embodiments, nylon 6, nylon 6/6, amorphous nylon, and ethylene/propylene copolymer.

The polymer components used to fabricate films according to the presently disclosed subject matter can also comprise appropriate amounts of other additives normally included in such compositions. For example, slip agents (such as talc), antioxidants, fillers, dyes, pigments and dyes, radiation stabilizers, antistatic agents, elastomers, and the like can be added to the disclosed films.

There is generally no limit to the number of layers used for the film structure provided that the various functional requirements are met. Accordingly, the film can comprise 1, 2, 3, 4, 5, 6, 7, 8, 9, 10, 11, 12, 13, 14, 15, 16, 17, 18, 19, or 20 layers. One of ordinary skill in the art would also recognize that the disclosed film can comprise more than 20 layers, such as in embodiments wherein the film components comprise microlayering technology.

In some embodiments, it is envisaged that pouch 5 can be produced in various different sizes, depending on the product to be packaged. For example, a 0.5 pint to 1 gallon size (the dimensions of the pouch being adjusted to give the appropriate volume) can be fabricated. Thus, in some embodiments, pouch 5 can be prepared in 0.5, 1, 1.5, 2, 2.5, 3, 3.5, 4, 4.5, 5, 5.5, 6, 6.5, 7, 7.5, or 8 pint (1 gallon) sizes. Larger or smaller volumes are also contemplated and are included within the presently disclosed subject matter. In addition, as would be readily apparent to one of ordinary skill in the art, the gallon measurements can easily be converted to liter or other suitable measurements.

Figure 2:
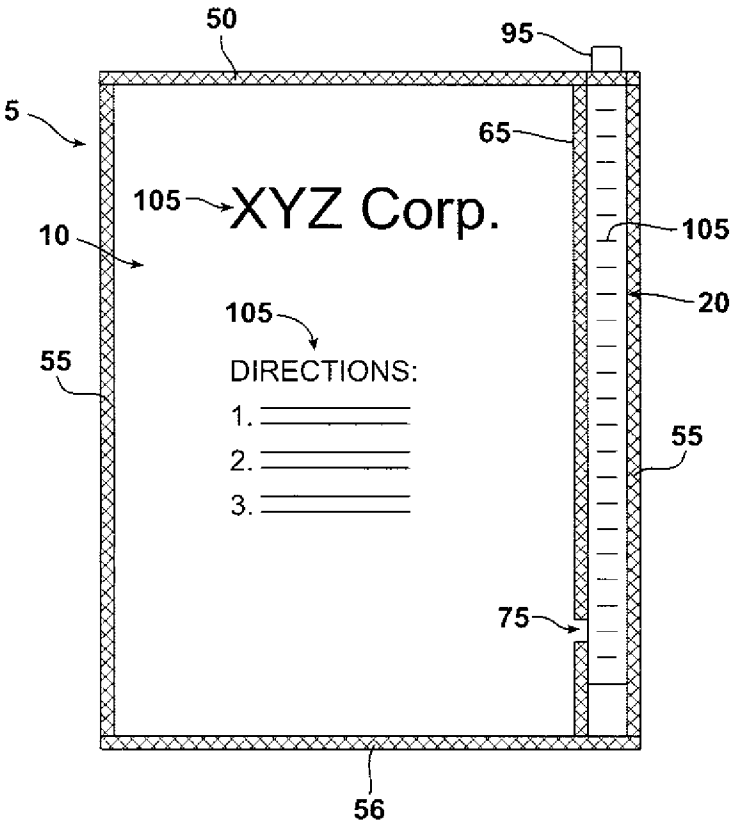

In some embodiments, films 35, 40 can accommodate printing. FIG. 2 illustrates that storage compartment 10 and/or dispensing compartment 20 can comprise printing on the surface of the walls of pouch 5. Such demarcations can denote a wide range of meanings and values, including (but not limited to) addresses, advertising messages, call numbers, codes, company names, event commemorations, event dates, decorative art, facility names, formulas, instructions, Internet addresses, numbers, measurement lines, logos, meaningful images, notations, promotional slogans, trademarks, and other communications. For example, in some embodiments, dispensing compartment 20 can be imprinted with one or more demarcations 105, which can include numbers and/or measurement lines. To this end, in some embodiments, numeric indicia can be imprinted at various intervals along the dispensing compartment to facilitate quantifying the amount of flowable material present therein. In some embodiments, at least a part of front or rear sheets 35 or 40 can be opaque to facilitate the reading or deciphering of any marking placed on pouch 5. However, in some embodiments, one or both of sheets 35 and 40 are fully or partially transparent to allow the visual inspection of the quantity, location, and/or measurement of the flowable product in the storage and dispensing compartments such that proper manipulation is possible.

Figure 3:
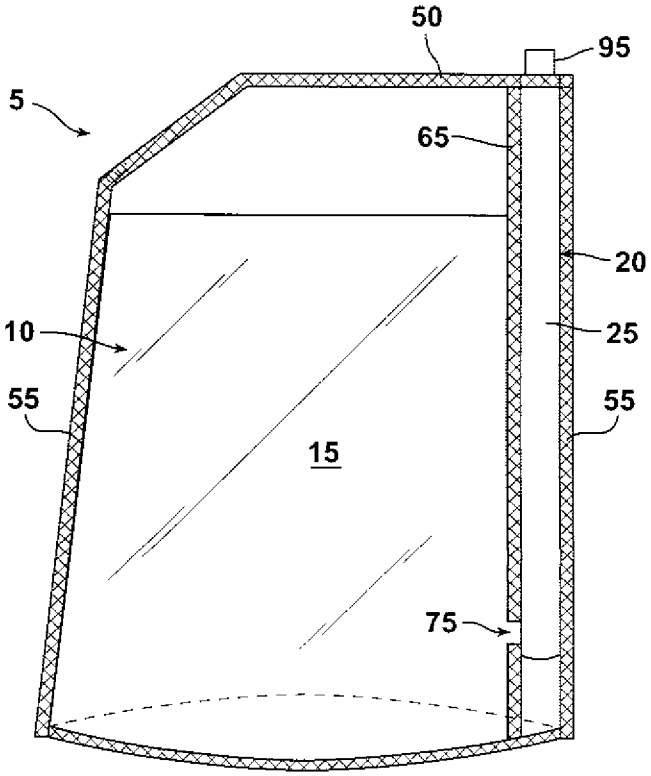
FIGS. 2 and 3 are front elevation views of pouches in accordance with some embodiments of the presently disclosed subject matter.

Those skilled in the art will understand after a review of the presently disclosed subject matter that the particular shape and size of pouch 5 can be selected as needed to suit the particular product to be packaged. For example, as set forth herein, pouch 5 can in some embodiments comprise a simple lay flat pouch, while in other embodiments, a stand-up pouch is envisioned. To this end, as illustrated in FIG. 1*a*, pouch 5 can be configured in an approximately rectangular shape. However, it should be understood that pouch 5 can be constructed in any of a wide variety of shapes, including (but not limited to) circular, oval, square, amorphous, or any other configuration. For example, as illustrated in FIG. 3, in some embodiments, storage compartment 10 and dispensing compartment 20 can be structured such that pouch 5 resembles a pitcher configuration to facilitate pouring and dispensing of the pouch contents.

III.B. Storage Compartment 10

Figure 4A:
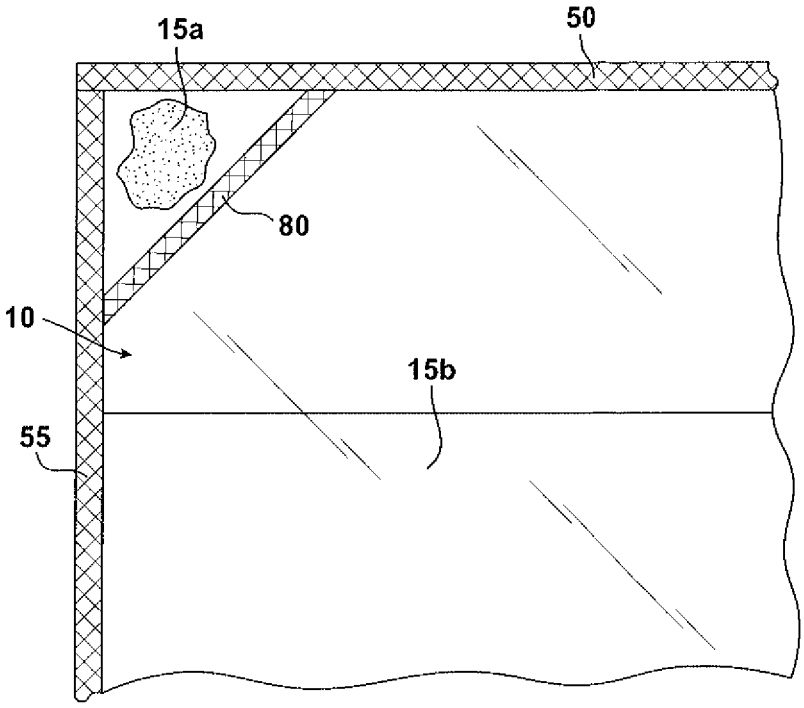
FIGS. 4*a* and 4*b* are fragmentary views of storage compartments of pouches in accordance with some embodiments of the presently disclosed subject matter.

As set forth herein above, storage compartment 10 houses flowable product 15 prior to dispensing. To this end, in some embodiments, storage compartment 10 houses a single flowable product. However, the presently disclosed subject matter also includes embodiments wherein the storage compartment houses 2 or more products. In some embodiments, the two or more products can be mixed by a user on demand (such as a solvent and a cleaning concentrate). For example, as illustrated in FIG. 4*a*, storage compartment 10 can comprise at least one frangible seal 80 separating first and second products 15*a* and 15*b*. As would be appreciated by those of ordinary skill in the art, frangible seal 80 can be ruptured by mechanical or user-applied pressure to allow flowable products 15*a*, 15*b* to intermix. In some embodiments, only one of first and second products 15*a*, 15*b* is flowable (i.e., first product 15*a* can be a powder that dissolves within flowable product 15*b*). Frangible seal 80 can be positioned in any orientation and is not limited by the embodiment illustrated in FIG. 4*a*.

Figure 4B:
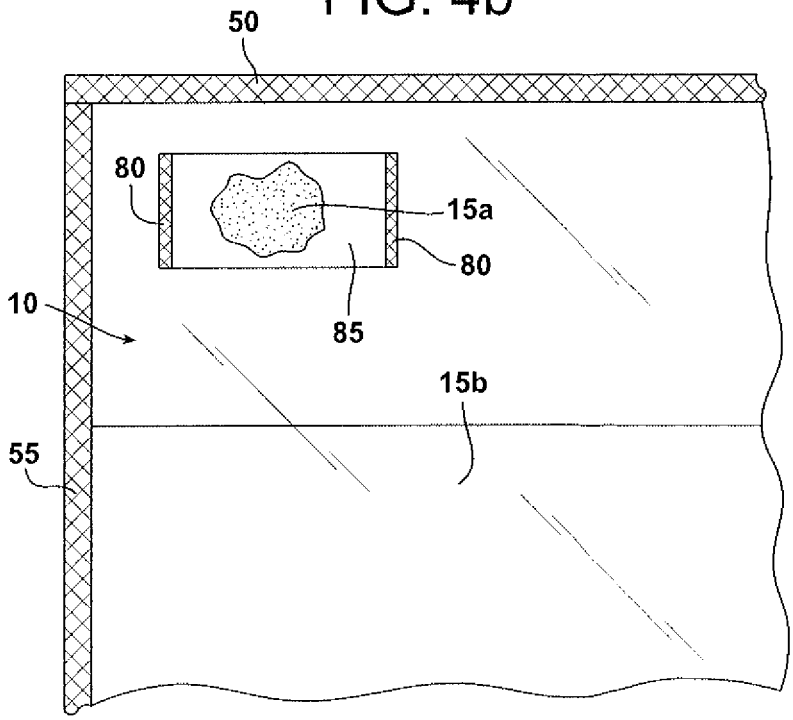

As illustrated in FIG. 4*b*, in some embodiments, storage compartment 10 can house at least one sachet 85 comprising at least one product 15*a* and at least one product 15*b* housed within the main body of the storage compartment. The sachet can include at least one frangible seal 80 such that a user can manipulate the sachet manually or mechanically through the pouch to rupture the frangible seal and allow products 15*a* and 15*b* to intermix. In these embodiments, it is possible that only one of first and second products 15*a*, 15*b* is flowable. For example, first product 15*a* housed within sachet 85 can be a powder that dissolves within flowable product 15*b* when intermixed. Sachet 85 can be made from any suitable material, and in some embodiments can be made from a polymeric material, with a thickness of between about 0.1 and 100 mils. However, the film used to construct sachet 85 can have any total thickness desired, so long as the film provides the desired properties, e.g., optics, modulus, seal strength, etc., for the particular packaging operation in which the film is used.

III.C. Dividing Seal 65

As depicted in FIG. 1*a*, pouch 5 comprises dividing seal 65 positioned between front sheet 35 and rear sheet 40 to divide the pouch into storage compartment 10 and dispensing compartment 20. Dividing seal 65 comprises channel 75, which can be any break in the seal to form a passageway between the two compartments. Thus, in some embodiments, channel 75 can be an unsealed portion, duct, one way valve, or other passageway that allows communication between storage compartment 10 and dispensing compartment 20. Pouch 5 is structured such that channel 75 nevertheless serves as an effective means to largely isolate the contents of the two compartments in a normal state where there is essential pressure equivalence between the two compartments, but to allow material to pass under an overpressure from storage compartment 10 into dispensing compartment 20. In this way, flowable product can be moved from storage compartment 10 to dispensing compartment 20, but only at a desired time (i.e., when the internal pressure within the storage compartment is increased, such as by applying manual or mechanical pressure).

In some embodiments, the backflow of the flowable product from dispensing compartment 20 into storage compartment 10 can be minimized by constructing channel 75 as a one-way valve. Particularly, channel 75 can be a one-way valve that only allows flowable product to flow from storage compartment 10 into dispensing compartment 20. The one-way valve can be a multi-component one-way valve, as is well known to those of ordinary skill in the art. However, in some embodiments, channel 75 can be constructed as a tapered structure that acts as a simple one-way valve.

Dividing seal 65 can be constructed in any method known in the art, including (but not limited to) heat, pressure, mechanical closures, and/or adhesives. Similarly, channel 75 can be made using methods known to those of ordinary skill in the art. For example, in some embodiments, channel 75 can be constructed by deliberately leaving unsealed a portion of dividing seal 65 between the storage compartment and the dispensing compartment.

Figure 5:
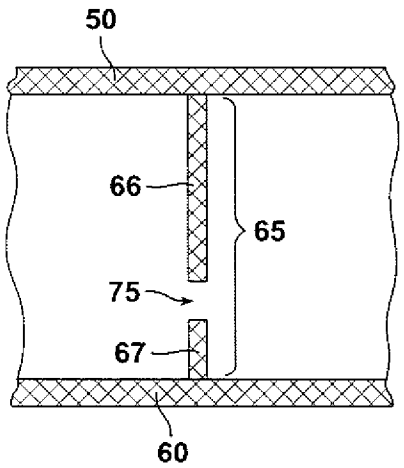
FIG. 5 is an enlarged view of a dividing seal in some embodiments of the presently disclosed subject matter.

In some embodiments, channel 75 can be located toward the bottom of the pouch (i.e., opposite dispensing unit 95 where the pouch contents are finally dispensed). However, channel 75 can be located anywhere on dividing seal 65, so long as it allows communication between the two compartments. Thus, as illustrated in FIG. 5, dividing seal 65 comprises top seal segment 66 (which spans the distance between pouch top seal 50 and channel 75) and bottom seal segment 67 (which spans the distance between channel 75 and the pouch bottom seal 60). In some embodiments, the total length of bottom seal segment 67 is at least about 1%, 2%, 5%, 7%, 10%, 15%, 20%, 25%, 30% 35%, 40%, 45%, 50%, 55%, 60%, 65%, 70%, 75%, 80%, 85%, 90%, 95%, 98%, or 99% of the total length of top seal segment 66.

III.D. Dispensing Compartment 20

Dispensing compartment 20 comprises support member 25 that can function to support the pouch, assist in maintaining the pouch upright position, provide a handle, and/or dispense flowable product 15. As would be understood by those of ordinary skill in the art, the structural integrity of pouch 5 is not compromised by dividing seal 65 at least in part because support member 25 ensures that the overall shape of the pouch is maintained.

In some embodiments, support member 25 is simply positioned within dispensing compartment 20, such that it has room to slightly adjust position. Alternatively, in some embodiments, support member 25 can be affixed to the dispensing compartment in a wide variety of ways, such as through the use of adhesives, heat sealing, an interlocking mechanism, and the like. For example, in some embodiments, a portion of the support member (e.g., base 115) can be heat sealed within top seal 50, as illustrated in FIG. 6*a*. In some embodiments, dispensing compartment 20 can include optional horizontal seal 70 positioned at the bottom of the compartment. Horizontal seal 70 functions to shorten the overall length of the dispensing compartment to more closely accommodate the length of support member 25 and to provide a more direct path of flowable product from channel 75 to the support member.

Support member 25 can be constructed from any of a wide variety of rigid or semi-rigid materials known in the art, including (but not limited to) molded plastic, molded rubber, wood, ceramics, metal, and/or any durable solid or semi-solid material. Further, the support member can be constructed from any material that is of sufficient strength to support the weight of the pouch. Such rigid or semi-rigid materials function to support the pouch and allow it to maintain its shape when the pouch is filled, during use, and when the pouch has been emptied. Similarly, support member 25 can be configured in any of a wide variety of shapes and should be not construed to be limited to the embodiments illustrated in the figures. For example, in some embodiments, the support member can be of a tapered design, with a relatively narrow portion positioned near the dispensing end of the compartment.

Figure 6B:
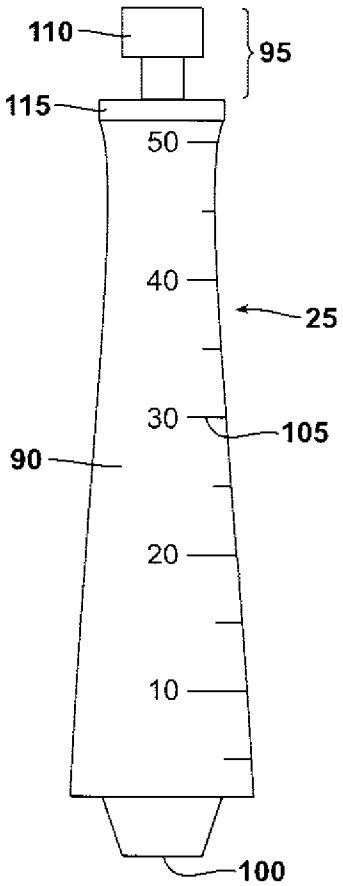
FIG. 6*b* is a front elevation view of a support member in accordance with some embodiments of the presently disclosed subject matter.
Figure 6A:
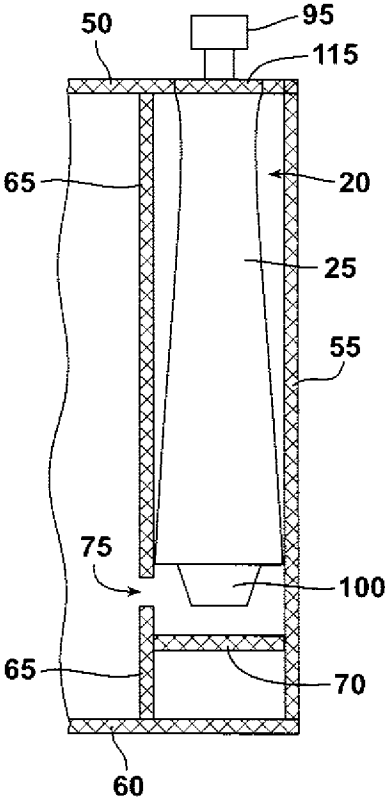
FIG. 6*a* is an enlarged view of a dispensing compartment of a pouch in accordance with some embodiments of the presently disclosed subject matter.

As illustrated in FIG. 6*b*, support member 25 comprises housing 90, dispensing unit 95, and inlet valve 100. When flowable product 15 enters dispensing compartment 20 via channel 75, it flows first into inlet valve 100, which is positioned on the distal end of the support member. In some embodiments, valve 100 is a one-way valve. However, valve 100 can include any of a wide variety of valves known in the art, including (but not limited to) umbrella valves, duckbill valves, ball valves, diaphragm valves, spring actuated valves, spring return valves, spring loaded ball valves, breather orifices, and the like. Valve 100 can be formed as part of support member 25, or can be a separate piece affixed to one end of the support member through the use of adhesives, interlocking mechanisms, and the like, as would be known in the art.

It should be recognized that inlet valve 100 is an optional feature, and the presently disclosed subject matter includes embodiments wherein the support member does not include an inlet valve. Particularly, in embodiments wherein the support member lacks valve 100, a user applies pressure to the pouch to transfer flowable product from storage compartment 10 directly into the dispensing compartment and housing 90. As set forth herein above, channel 75 is in some embodiments a one-way seal to prevent or at least deter flowable product from re-entering storage compartment 10 once it passes to the dispensing compartment. In addition, the resistance in channel 75 prevents additional flowable product from flowing into the dispensing compartment.

Once flowable product enters housing 90, it can optionally be metered prior to dispensing. To this end, in some embodiments, housing 90 comprises demarcations 105 printed on the housing itself to allow a user to accurately control the volume to be measured and dispensed, as illustrated in FIG. 6*b*. Alternatively or in addition, as set forth herein above, demarcations can be printed directly onto the pouch materials that overlay the support member. In some embodiments, the volume of housing 90 is designed to hold a predetermined fraction of the total volume of flowable material in storage compartment 10.

Once a desired amount of flowable product enters housing 90, it can be dispensed out of the pouch through dispensing unit 95. Particularly, dispensing unit 95 can comprise any of a wide variety of dispensing mechanisms known in the art, including (but not limited to) fitments, tubes, ports, valves, handles, spouts, spigots, siphons, pumps, taps, nozzles, hoses, or combinations thereof. In some embodiments, dispensing unit 95 can include a closure (such as, but not limited to, cap 110) operably engaging the dispensing unit to ensure that no flowable product is dispensed at an undesired time. As set forth herein above, in some embodiments, support member 25 can include base 115 for proper orientation. For example, base 115 can be heat sealed into top pouch seal 50 to orient the support member into a desired position.

IV. Methods of Using the Disclosed Pouch

Figure 7A:
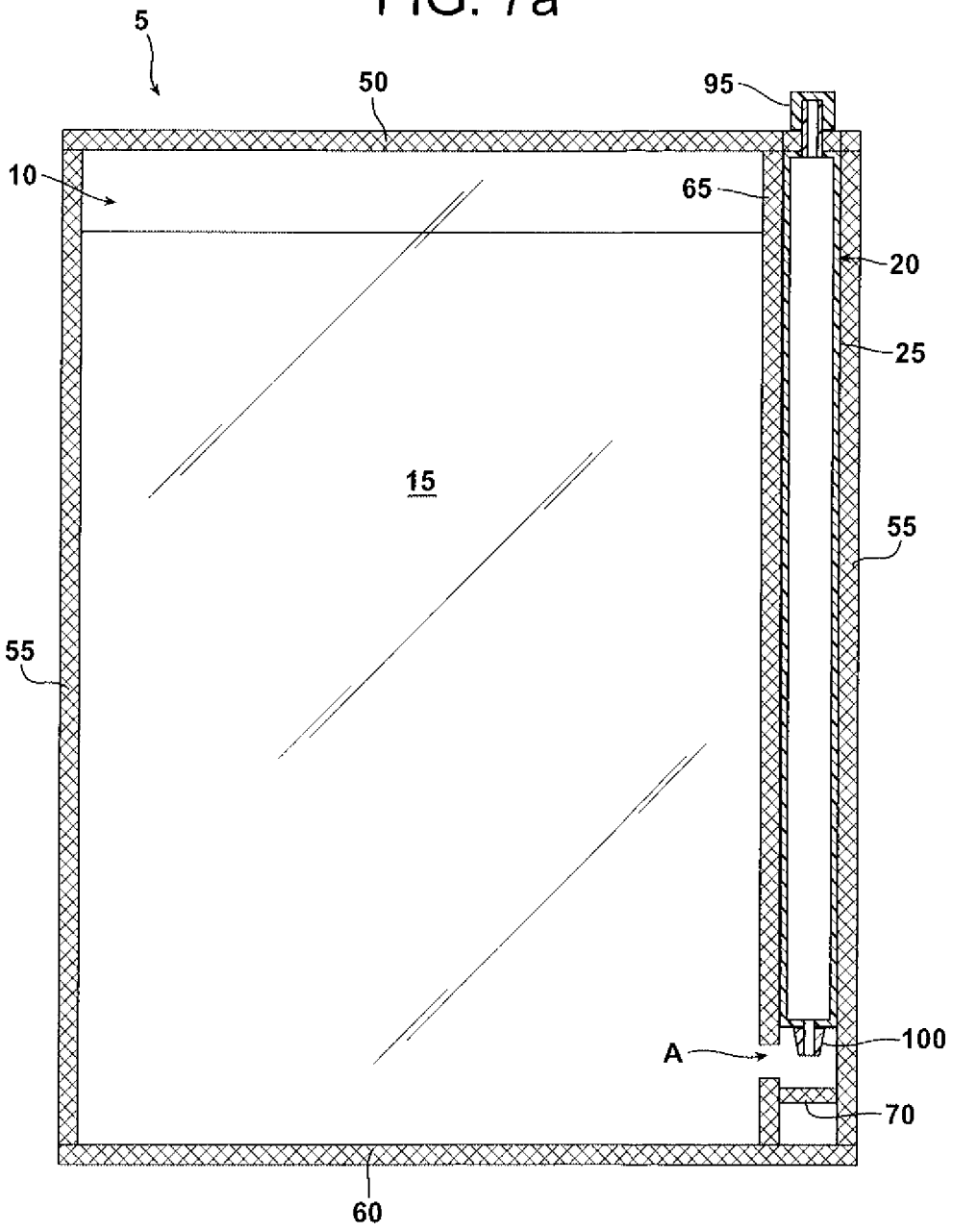
FIG. 7*a* is a front elevation view of a pouch in accordance with some embodiments of the presently disclosed subject matter.

Metering and/or dispensing can be initiated by removing cap 110 or any other associated closure device from the dispensing unit (in embodiments wherein dispensing unit 95 includes such a device), and then manually or mechanically compressing storage compartment 10. Due to the increased pressure within the storage compartment, flowable product is forced from the storage compartment through channel 75 of dividing seal 65, as represented by Arrow A in FIG. 7*a*. The amount and rate of flowable product transferred from storage compartment 10 to dispensing compartment 20 can be easily controlled by the amount of pressure applied by the user and can be gauged by eye given the transparency of at least part of one wall of pouch 5. In addition, users can use measuring lines or other indicia printed on the dispensing compartment and/or support member to determine the amount of flowable product 15 in the dispensing compartment.

Figure 7B:
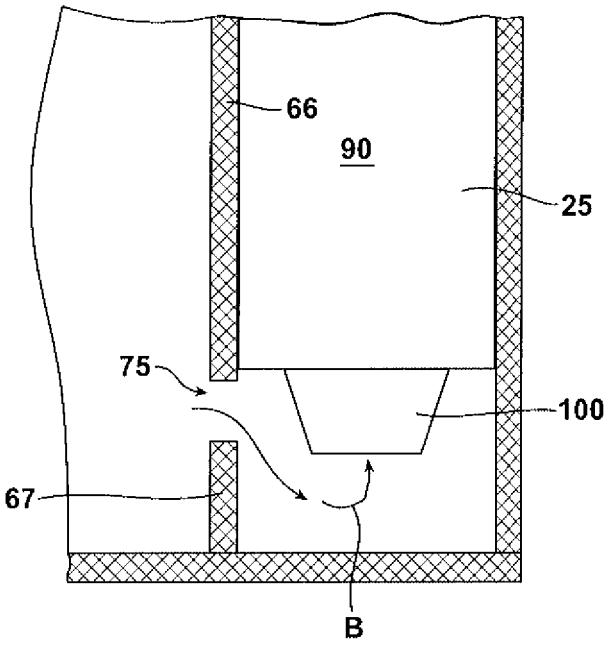
FIG. 7*b* is an enlarged fragmentary view of the pouch of FIG. 7*a*.

The flowable product entering dispensing compartment 20 flows into housing 90 of support member 25 for metering and/or dispensing. Particularly, in embodiments wherein support member 25 comprises inlet valve 100, the flowable product enters the valve and travels into the housing, as illustrated by Arrow B in FIG. 7*b*. As illustrated in the Figure, in some embodiments, housing 90 is flush with the sides of dispensing compartment 20 to ensure that the flowable product is forced into the support member for dispensing.

Figure 7C:
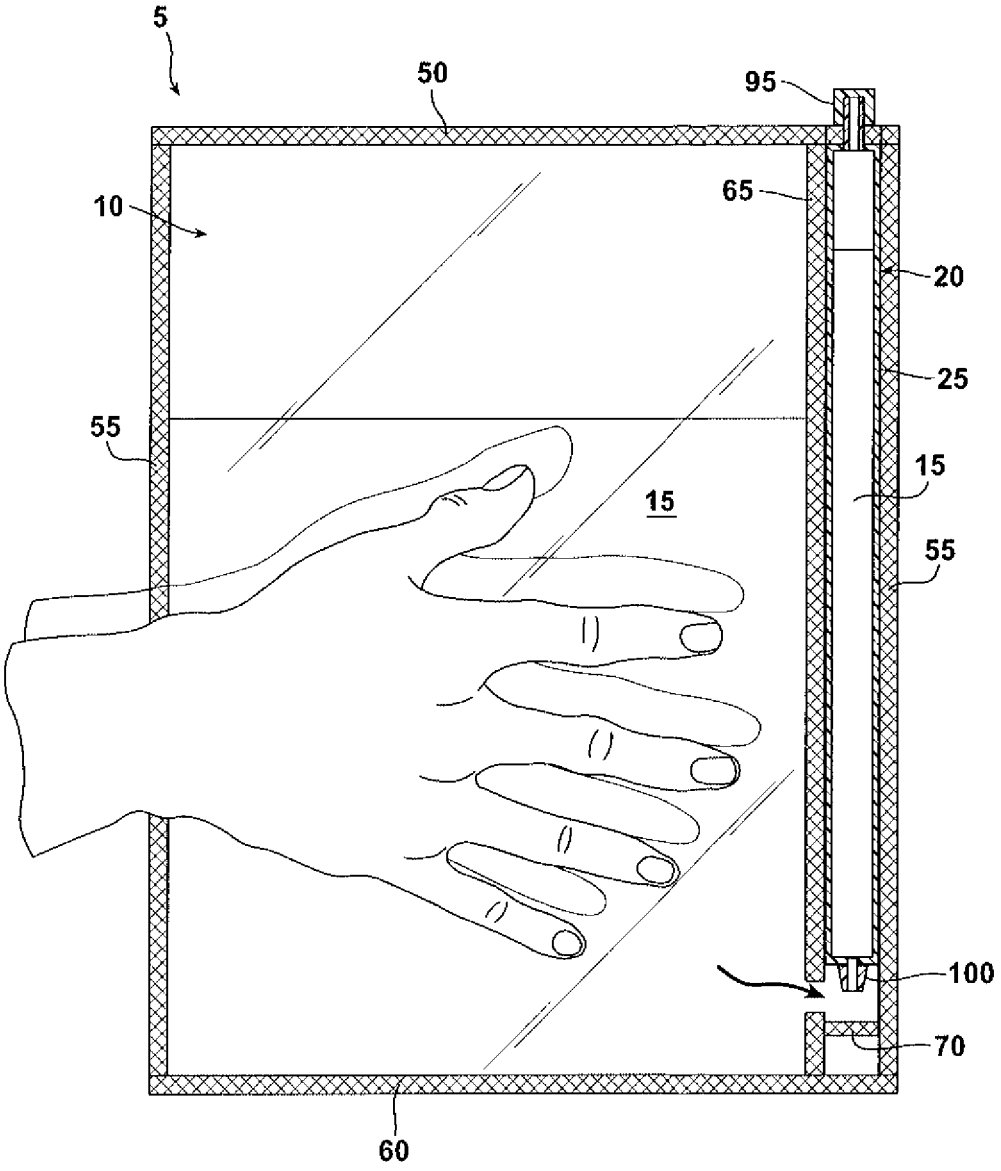
FIGS. 7*c* and 7*d* are front elevation views of the pouch of FIG. 7*a* during use in accordance with some embodiments of the presently disclosed subject matter.

The user continues applying pressure to the storage compartment until a desired volume of flowable product enters housing 90 of the support member, as illustrated in FIG. 7*c*. As set forth herein above, the amount of flowable product that enters the dispensing compartment (i.e., support member 25) can be measured via demarcations 105. Alternatively or in addition, the support member can hold a known volume such that demarcations are not needed (i.e., the support member holds an amount of laundry detergent sized for one load). Once a desired amount of flowable product has entered housing 90 of the support member, the user ceases pressure on the storage compartment, thereby stopping the transfer of flowable product. When pressure stops, the flowable product housed in the dispensing compartment remains therein, at least in part because channel 75 and/or inlet valve 100 resist backflow of flowable product.

Figure 7D:
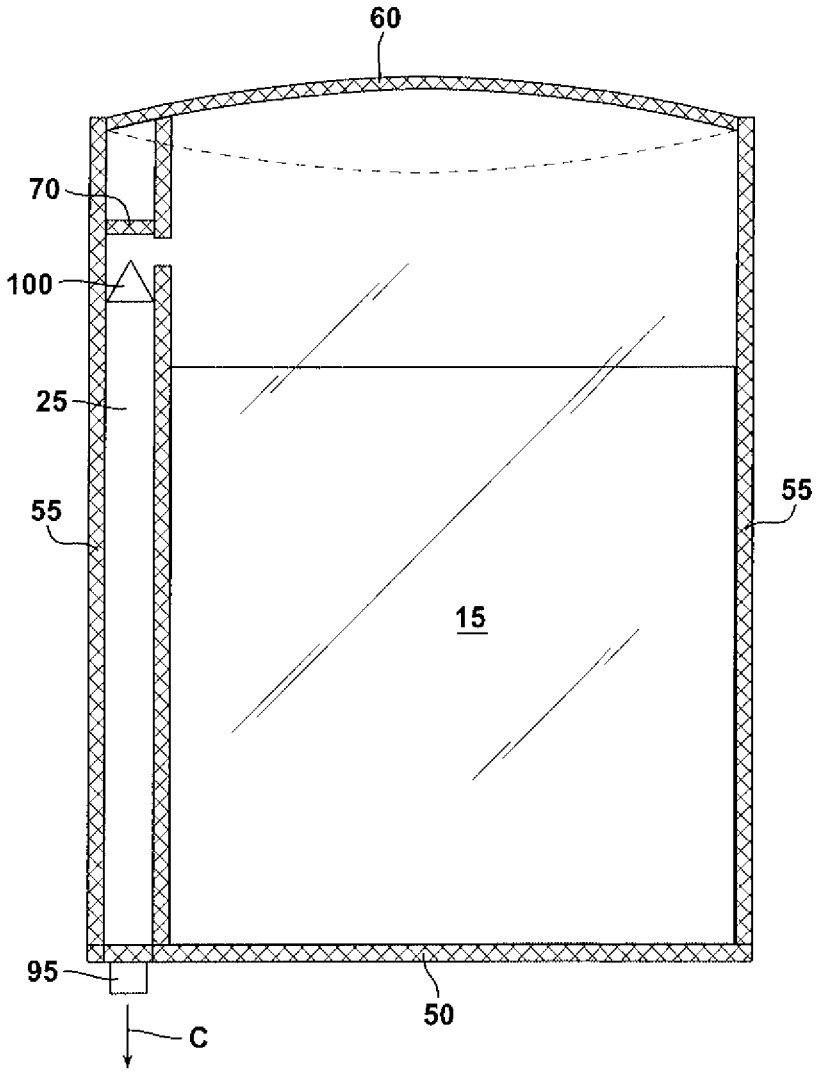

When dispensing is desired, dispensing unit 95 of the support member is initiated. In this way, a measured dose of flowable product 15 can be distributed out of the pouch. In some embodiments, dispensing can be accomplished by rotating the pouch (i.e., the pouch can be fully or partially inverted with the dispensing unit positioned below the pouch bottom seal) such that gravity forces the flowable product out of the support member, as illustrated by arrow C in FIG. 7*d*. Alternatively or in addition, dispensing unit 95 can be associated with an exterior unit (such as a valve, spout, fitment, etc.) to force the pumpable product out of the support member. Such exterior units are well known to those of ordinary skill in the packaging art and can encompass a wide variety of such elements. Thus, support member 25 performs the role of optionally metering and containing the flowable product from storage compartment 10 and acts as a dispensing structure that cleanly, accurately, and with little or no waste, deposits the dose into a hand or other holding device.

V. Flowable Product 15

The presently used dispensing system can be used with a wide variety of flowable products, including but not limited to, food items, beverage items, and personal care items. Food products suitable for use with the presently disclosed subject matter can include edible products, such as catsup, chutneys, coffee and other food or beverage extracts, cream, dairy products, dips, essential oils, flavorings, foods, frostings, fruit spreads, glazes, horseradish, jams, jellies, marinades, mayonnaise, mustard, nutritional supplements, oils, preserves, pudding, relish, salad dressings, salsa, sauces (such as hot and pepper sauces, teriyaki sauce, dessert sauces, pesto sauces, pasta sauces, soy sauce, barbeque sauces, sweet and sour sauces, hot, or grilling sauces), seasoning blends, syrups, vinegars, vinaigrettes, or any other types of flowable food items.

Beverages suitable for use with the presently disclosed subject matter can include, but are not limited to, carbonated beverages including soft drinks, coffee drinks, energy drinks, fruit and vegetable juices, hot chocolate, milk and other dairy beverages, sports beverages, tea, water, wine and other alcoholic beverages, and other type of flowable natural and/or artificial flavored beverages.

The presently disclosed subject matter can also be used with a wide variety of personal care products, including but not limited to, body oils, body washes, bubble bath, cleaning products (including oils, floor cleaners, carpet cleaners, furniture cleaners, appliance cleaners, disinfectants, gels, glass cleaners, detergents, liniments, pastes, polishes, stain removers, allergen removers, sanitizing systems), colorants, conditioners, creams, deodorants, fabric conditioners, fabric softeners, hairdressings, hair treatments, hand soaps, insect repellants, laundry products, lotions, lubricants, medications, mineral solutions, moisturizers, mouthwashes, ointments, petroleum jellies, pharmaceuticals, salves, shampoos, shaving creams, soaps, sunscreens, and any other types of flowable personal care items.

Thus, the presently disclosed subject matter can be used for dispensing flowable products including low viscosity fluids (e.g., juice and other beverages), high viscosity fluids (e.g., condiments and sauces), and the like. Non-food products such as fertilizers, motor oil and engine additives, wet cosmetics, medicaments, and the like can also be beneficially packaged and dispensed in the presently disclosed system. One of ordinary skill in the art can appreciate that the above list is not exhaustive, and the presently disclosed system and methods can be used in packaging applications not listed hereinabove.

VI. Advantages of the Disclosed System

The presently disclosed system can be used to economically package and dispense a wide range of flowable materials. Pouch 5 provides an easy indicator to the end user (based on pre-learned methods of opening bottles and the like) as to how the contents of the pouch can be accessed. In some embodiments, graphics on pouch 5 can also help the user to correctly apply the flowable material onto a desired object by providing a visual indicator as to the precise location of the exit orifice of the pouch.

The disclosed pouch can also be manufactured economically, thereby allowing producers to offer products to end users with a more significant price reduction compared to those pouches and systems that have been available in the past.

Currently, flexible pouches are only rarely used for home dispensing of products, such as fabric softeners, cooking oils, etc. These pouches typically have a pump or spout that is time consuming to use and most often is located at the bottom of the package and must be placed at the edge of the counter to dispense the product. The presently disclosed pouch allows accurate dispensing of the product at a height convenient to the end user. In addition, the dispensing opening will not have to be located over the edge of a counter and is not required to be associated with a pump or spout.

In addition, the system allows the end user to make the best use of limited storage space by allowing for the stacking of the pouches. In comparison, most liquid or pumpable end user products that are dispensed over time are contained in bottles. The bottles are heavy (adding to freight costs during distribution), not stackable, and have limited label area for graphics.

An advantage of the presently disclosed system is that no manual refilling of the packaged product is necessary. When a pouch is empty, it can be discarded and a new pouch filled with flowable product can then be used.

The dispensing pouch can be purchased fully assembled and ready to use, thereby allowing a user to use the pouch without first having to assemble part of a container. Moreover, the pouch can be filled using an automated filling unit, and can be easily collapsed and disposed of when empty.

Furthermore, the disclosed pouch provides a metering device to a pouch for very little added cost. The pouch overcomes limitations in previously seen configurations by overcoming the loss of structural rigidity and metering flow efficiency as have been seen in previous metering pouches created by simply having a seal between two reservoirs.

What is claimed is:

1. A flexible dispensing pouch comprising:

a. a storage compartment configured to house a flowable product prior to metering, dispensing, or both;

b. a dispensing compartment comprising a rigid or semi-rigid support member comprising:

i. a housing that houses the flowable product during metering, dispensing, or both;

ii. a dispensing unit that allows the flowable product to exit compartment; and iii. an inlet valve; and c. a dividing seal separating the storage compartment from the dispensing compartment, wherein the dividing seal comprises a one-way channel to allow communication between the two compartments.

2. The dispensing pouch of claim 1, wherein said support member comprises a one-way valve.

3. The dispensing pouch of claim 1, wherein at least one of said storage compartment or dispensing compartment is fully or partially transparent to visualize said flowable product.

4. The dispensing pouch of claim 1, wherein said dispensing compartment, support member, or both are demarcated to accommodate metered dispensing.

5. The dispensing pouch of claim 1, wherein said dispensing unit comprises a fitment, tube, port, valve, handle, spout, spigot, siphon, tap, nozzle, hose, or combinations thereof.

6. The dispensing pouch of claim 1, wherein said pouch is a stand-up pouch, having a base for supporting the pouch in an upright position.

* * * * *